United States Patent [19]

Bassist

[11] 4,137,730

[45] Feb. 6, 1979

[54] NEEDLE SUPPORT ASSEMBLY FOR A KNITTING MACHINE

[76] Inventor: Rudolph G. Bassist, 1003 McGrann Blvd., Lancaster, Pa. 17601

[21] Appl. No.: 897,996

[22] Filed: Apr. 20, 1978

[51] Int. Cl.[2] ..... D04B 15/00; D04B 35/00

[52] U.S. Cl. ..... 66/114

[58] Field of Search ..... 66/114, 208, 88, 123, 66/119

[56] References Cited

U.S. PATENT DOCUMENTS

| | | | |
|---|---|---|---|
| 499,382 | 6/1893 | Gormly | 66/114 |
| 793,556 | 6/1905 | Wilson et al. | 66/114 |
| 795,179 | 7/1905 | Tompkins | 66/114 |
| 2,654,237 | 10/1953 | Noe | 66/114 |
| 2,902,847 | 9/1959 | Kohl | 66/114 |

*Primary Examiner*—Ronald Feidbaum
*Attorney, Agent, or Firm*—Alan H. Levine

[57] ABSTRACT

A needle support assembly including a needle support member, such as a needle bar, a row of knitting needles arranged against the support member, and a spacer between each two successive needles. The spacers are independent of the needles and support member, and are of precisely equal thicknesses, so that each two successive needles in the row are spaced apart the same predetermined distance. As a result, the usual series of parallel slots in the needle bar, or other support member for the needles, can be eliminated. The needle support member may have a groove for accommodating a butt projecting laterally from each needle and spacer, or the support member may have a ridge or ridges over which a notch or notches in each needle and spacer fits. Thin plates extend across the groove or ridges at regularly spaced apart locations, and a predetermined number of needles and spacers fit between each two plates, the spacers abutting the plates being slightly thinner than the other spacers. Alternatively, the needle support member may be flat, i.e., without a groove or ridges, and independent bars assembled with the needles and spacers by fitting into notches provided in those elements.

8 Claims, 6 Drawing Figures

FIG. 1
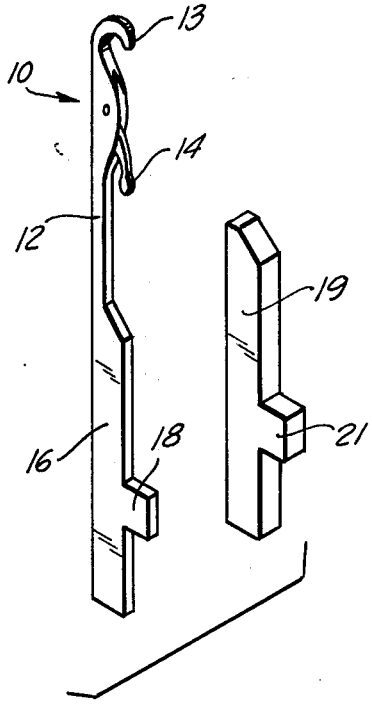
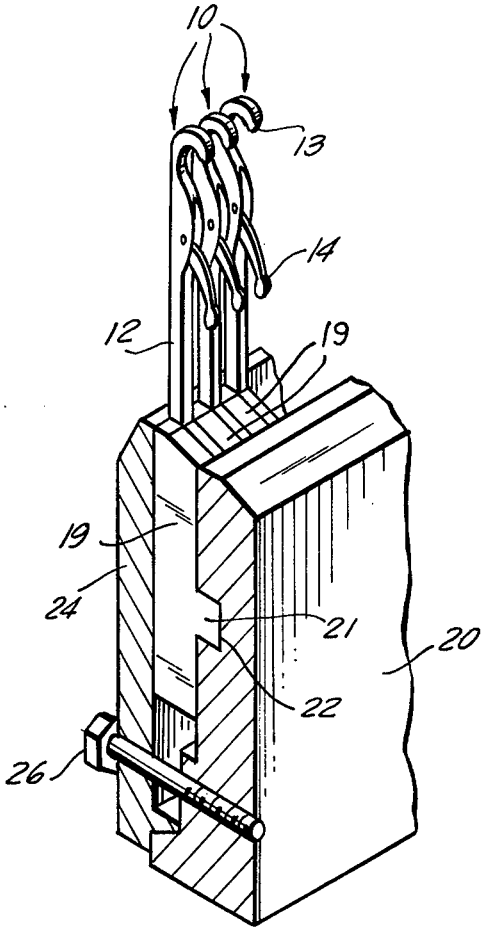
FIG. 2
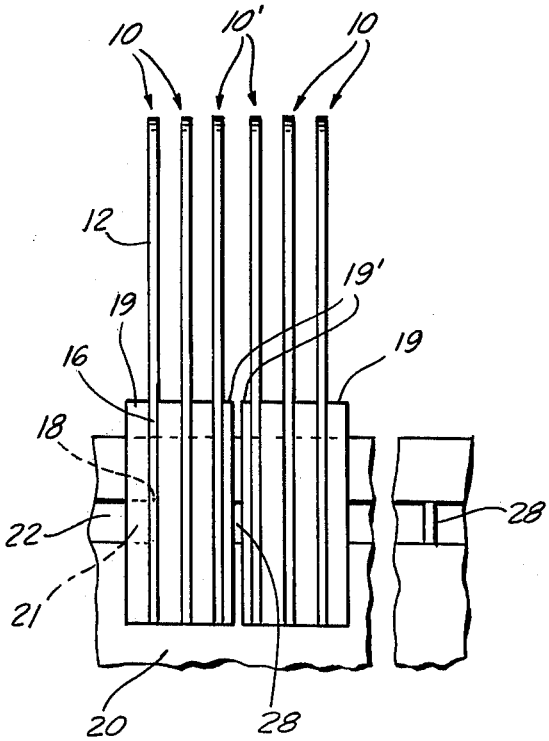
FIG. 3

NEEDLE SUPPORT ASSEMBLY FOR A KNITTING MACHINE

This invention relates to knitting machines, and more particularly to the knitting needles and needle support members of such machines.

A conventional knitting needle for a knitting machine has a hook-shaped upper end portion and an elongated shank, the shank having the same thickness throughout its length. Hundreds of such needles are supported by a support member, the support member being a horizontally elongated needle bar. Conventionally, the support member is provided with hundreds of vertical, parallel machined slots, each slot accommodating the shank of one needle. The slots are precisely machined so as to be equidistantly spaced along the length of the needle bar or around the periphery of the cylinder, the purpose of the slots being to precisely space the needles equidistantly along the support member, this spacing being referred to as the "gauge" of the machine.

While this conventional arrangement functions satisfactorily, it requires that the entire support member be replaced when the gauge of the knitting machine is to be changed. In addition, a problem presented is that machining the series of slots in the support member is an expensive and time consuming operation. Furthermore, should one of the walls remaining between slots break, either during machining or thereafter, the support member must be repaired.

It is a general object of the present invention to overcome this problem by providing a needle support assembly wherein knitting needles are precisely spaced apart along a support member without requiring that the support member be provided with a series of slots for accommodating the needles. Thus, the same support member can be used even when the gauge of the machine is varied.

It is another object of the invention to provide spacers of precise thickness between each two successive knitting needles for locating each two successive needles, in a contiguous row of such needles, at a predetermined distance from each other equal to the spacing between each of the other successive pairs of needles.

It is a further object of the invention to provide the needle support member with precisely spaced-apart guide plates along the length of the support member for insuring that the predetermined spacing between successive pairs of needles is maintained along the entire length of the support member.

Additional objects and features of the invention will be apparent from the following description in which reference is made to the accompanying drawings.

IN THE DRAWINGS

FIG. 1 is an exploded perspective view of a knitting needle and spacer according to the present invention;

FIG. 2 is a fragmentary perspective view of a series of such needles and spacers mounted on a needle bar;

FIG. 3 is a fragmentary elevational view of a needle bar supporting a plurality of such needles and spacers, the clamping plate having been removed;

Figure 4:
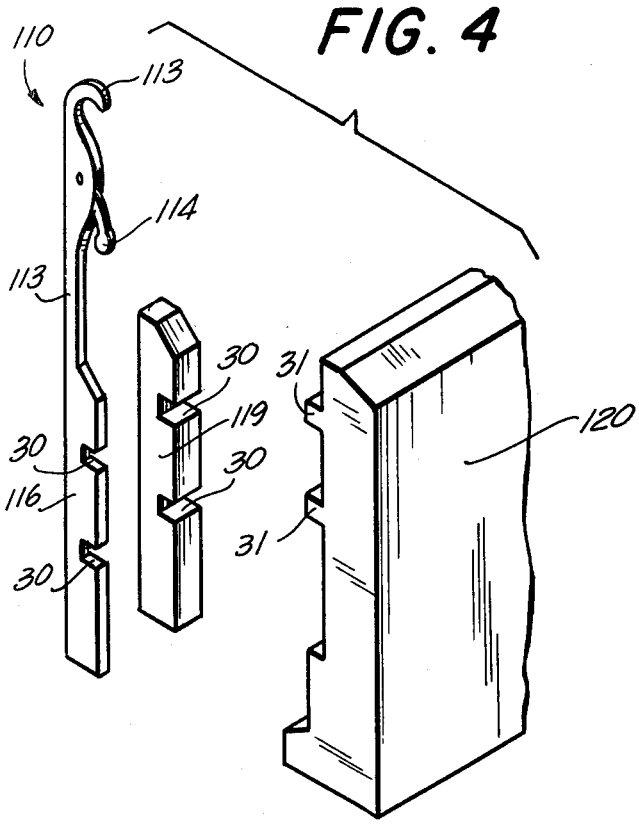
FIG. 4 is an exploded perspective view of an alternative embodiment of a knitting needle, spacer, and needle bar according to this invention.

The knitting needle 10 shown in FIGS. 1–3 is of the latch needle type, and comprises a straight stem 12 having a hook-shaped upper end portion 13 and a shank 16 at its lower end. The hook 13, stem 12, and shank 16 are all integrally formed of a single piece of metal, such as steel. As usual, stem 12 is enlarged immediately beneath hook 13, the enlargement slotted, and a latch 14 pivotally mounted within the slot. Stem 12 and shank 16 are of uniform side-to-side thickness, but the shank is widened in a front-to-back direction as shown in FIGS. 1 and 2. The needles 10 are of completely conventional construction.

According to the present invention, a plurality of spacers 19 are provided, each spacer having a peripheral shape similar to the shape of needle shank 16, including a laterally projecting butt 21. The thickness of each spacer 19 is very precisely made to a predetermined dimension, depending upon the gauge, i.e., distance between successive needles 10, which the needle bar is to have. The wide faces of each spacer, seen in FIGS. 1 and 2, are made flat and smooth. When assembling needles 10 with a needle support member 20, a spacer 19 is spaced between each two successive needles 10 in the row so that the wide faces of each spacer contacts the wide faces of the needle shanks 16 on both sides of the spacer. Consequently, spacers 19 serve to equally space the needles 10 of the successive needles a predetermined distance apart. The spacing between the needles will conform to the gauge of the machine, and the gauge may be changed by removing spacers 19 and replacing them with spacers having a different thickness.

In this example, the support member for the row of needles 10 is illustrated as a needle bar 20. As usual, needle bar 20 is formed with a longitudinal guide in the form of a groove 22 for accommodating a butt 18 projecting laterally from each needle shank 16, and a butt 21 projecting laterally from each spacer 19. Cooperation of the butts 18 and groove 22 insure that the hooks 13 of all the needles in the row are at the same height. Cooperation of butts 21 and groove 22 insure that no spacer slips out of its place between its adjacent needles. The usual clamping plate 24, mounted on the needle bar 20 by means of bolts 26 (only one being shown in FIG. 2), clamps the needles 10 and spacers 19 tightly to the needle bar. It will be appreciated that since the needles 10 are precisely spaced apart by spacers 19, no vertical slots are required in needle bar 20 for accommodating the needles.

Preferably, thin vertical guide plates 28 extend across groove 22 at precisely spaced apart locations, say, every ten inches. Use of plates 28 insures that the precise spacing between needles is maintained along the entire length of needle bar 20. A predetermined number of needles 10 and spacers 19 fits between each two successive plates 28. To compensate for the thickness of each plate, the spacers 19' abutting each face of each plate are reduced in thickness an amount equal to one-half the thickness of the plate. Thus, the spacing between needles 10' is the same as the spacing between each of the other pairs of successive needles despite the presence of plate 28 between them. Alternatively, the arrangement may be such that one needle 10 abuts one face of plate 28, and a spacer 19 abuts the other face of the plate, the thickness of that spacer being reduced by the thickness of plate 28. In this way, the total thickness of plate 28 and the reduced thickness spacer will equal the thickness of the normal spacers 19, and the two needles 10 having plate 28 between them are spaced apart the same distance as every other pair of successive needles in the row.

In the description above, each needle 10 and a spacer 19 is furnished with a butt 18, 21, accommodated within groove 22 in needle bar 20. As shown in FIG. 4, wherein parts corresponding to those of FIGS. 1–3 bear the same reference numerals preceded by a "1", each needle 110 and spacer 119 could be formed with one or more notches 30 in place of the butt, and the needle bar 120 formed with a corresponding number of longitudinal guide ridges 31 over which the notches 30 fit snugly. Notches 30 and ridges 31 serve the same purpose as groove 22 and butts 18 and 21. Thin plates corresponding to plates 28 can be located at precisely spaced apart locations across ridges 31, possibly by fitting into transverse slots cut into the ridge.

Figure 5:
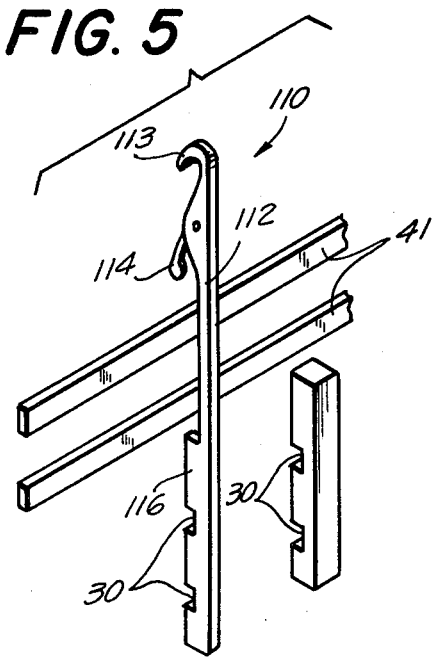
FIG. 5 is an exploded perspective view of another alternative embodiment of a knitting needle, spacer, and independent bars according to this invention.
Figure 6:
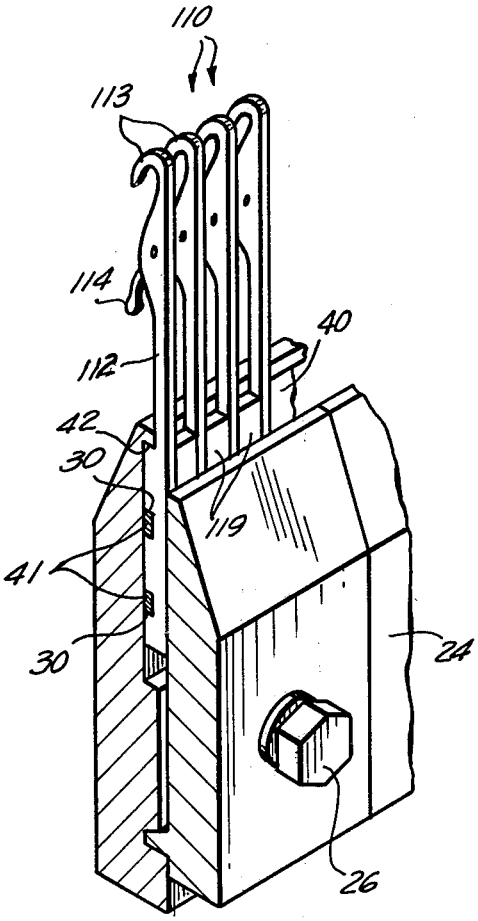
FIG. 6 is a fragmentary perspective view of the parts of FIG. 5 assembled with a needle bar.

In the embodiment of the invention shown in FIGS. 5 and 6, the needles 110 and spacers 119 may be identical to those shown in FIG. 4, i.e., each needle shank 116 and spacer has one or preferably at least two notches 30. The needle bar 20', on the other hand, has neither a groove 22 nor ridges 31. Instead surface 40, against which the needles and spacers are mounted by clamping plate 24, is made flat except for an overhanging lip 42 along its upper edge. Straight bars 41 are provided in a number equal to the number of notches 30 in each needle and spacer. The width of each bar 41 is such that its cross-section fits completely within a notch 30. In use, needles 110 and spacers 119 are arranged alternately in a contiguous row with all their corresponding notches 30 aligned, bars 41 are fitted into the aligned notches, and that assembly clamped in place against surface 40 of needle bar 20' by clamping plate 24, the latter being held in place by screws 26. The tops of spacers 119 and of needle shanks 116 fit against the bottom of lip 42. This arrangement offers the advantage of a needle bar which is very inexpensive to produce since it not only avoids the need for the conventional parallel slots, but also avoids the need for a longitudinal groove or ridges.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A needle support assembly for a knitting machine, comprising a needle support member, a row of knitting needles arranged against said support member, and a spacer between each two successive needles, said spacers being independent of said needles and said support member and being of precisely equal thicknesses, so that each two successive needles in the row are spaced apart the same predetermined distance.

2. A needle support assembly as defined in claim 1 wherein said support member is devoid of a series of slots for accommodating said needles, and said spacers are the only means separating said needles.

3. A needle support assembly as defined in claim 1 wherein said support member has a longitudinal guide, and each of said needles and spacers has means cooperating with said guide to prevent movement of said needles and spacers transversely of said support member.

4. A needle support assembly as defined in claim 3 wherein said guide is a groove, and said cooperating means are butts accommodated within said groove.

5. A needle support assembly as defined in claim 3 wherein said guide is a ridge, and said cooperating means are notches fitted over said ridge.

6. A needle support assembly as defined in claim 3 including thin plates extending across said guide at precisely spaced apart locations along the length of said groove, a predetermined number of needles and spacers fitting between each two successive plates, said number of needles and spacers fitting snugly between said plates.

7. A needle support assembly as defined in claim 6 wherein at least one face of each plate is engaged by a spacer, said plate-engaging spacer being reduced in thickeness by an amount sufficient to cause the two successive needles with a plate between them to be spaced apart the same distance as every other pair of successive needles.

8. A needle support assembly as defined in claim 1 wherein each of said needles and spacers is formed with at least one notch, and including at least one bar independent of said support member fitting into all the corresponding notches of said needles and spacers.

* * * * *